US011514869B2

(12) United States Patent
Qiu

(10) Patent No.: US 11,514,869 B2
(45) Date of Patent: Nov. 29, 2022

(54) OVER-CURRENT PROTECTION METHOD FOR DISPLAY PANEL AND DISPLAY DEVICE

(71) Applicant: HKC CORPORATION LIMITED, Guangdong (CN)

(72) Inventor: Bin Qiu, Guangdong (CN)

(73) Assignee: HKC CORPORATION LIMITED, Guangdong (CN)

( * ) Notice: Subject to any disclaimer, the term of this patent is extended or adjusted under 35 U.S.C. 154(b) by 92 days.

(21) Appl. No.: 17/264,300

(22) PCT Filed: Dec. 11, 2019

(86) PCT No.: PCT/CN2019/124553
§ 371 (c)(1),
(2) Date: Jan. 29, 2021

(87) PCT Pub. No.: WO2020/135049
PCT Pub. Date: Jul. 2, 2020

(65) Prior Publication Data

US 2021/0304694 A1 Sep. 30, 2021

(30) Foreign Application Priority Data

Dec. 25, 2018 (CN) ..... 201811598783.2

(51) Int. Cl.
*G09G 3/36* (2006.01)

(52) U.S. Cl.
CPC ..... *G09G 3/36* (2013.01); *G09G 2330/04* (2013.01)

(58) Field of Classification Search
CPC ..... G09G 3/36
See application file for complete search history.

(56) References Cited

U.S. PATENT DOCUMENTS

2011/0141644 A1* 6/2011 Hastings ..... H01L 31/02021 361/93.2
2012/0075764 A1 3/2012 Nakamoto et al.
(Continued)

FOREIGN PATENT DOCUMENTS

CN 103199506 A 7/2013
CN 103269548 A 8/2013
CN 106297702 A * 1/2017 ..... G09G 3/36
(Continued)

OTHER PUBLICATIONS

First Office Action in counterpart Chinese Application No. 201811598783.2, dated Mar. 18, 2020.
(Continued)

*Primary Examiner* — William Boddie
*Assistant Examiner* — Andrew B Schnirel

(57) ABSTRACT

The present application discloses an over-current protection method for display panel and a display device. The over-current protection method for display panel includes the following steps: calculating current input by a level shifter during a first preset time of a first clock signal after the first clock signal is received; determining whether the current input by the level shifter during the first preset time is larger than a first preset current; controlling the level shifter to stop running in determining that the current input by the level shifter during the first preset time is larger than the first preset current.

9 Claims, 4 Drawing Sheets

(56) References Cited

U.S. PATENT DOCUMENTS

| | | | | |
|---|---|---|---|---|
| 2014/0016240 | A1* | 1/2014 | Kawata | H02H 3/0935 361/95 |
| 2019/0080659 | A1* | 3/2019 | Zhang | H02H 1/0007 |

FOREIGN PATENT DOCUMENTS

| | | | |
|---|---|---|---|
| CN | 106297702 | A | 1/2017 |
| CN | 107257193 | A | 10/2017 |
| CN | 107395006 | A | 11/2017 |
| CN | 107508252 | A | 12/2017 |
| CN | 107527602 | A | 12/2017 |
| CN | 108010497 | A | 5/2018 |
| CN | 108173537 | A | 6/2018 |
| CN | 109064985 | A | 12/2018 |
| CN | 109637412 | A | 4/2019 |

OTHER PUBLICATIONS

International Search Report in corresponding PCT Application No. PCT/CN2019/124553, dated Feb. 26, 2020 and Written Opinion of the International Searching Authority in corresponding PCT Application No. PCT/CN2019/124553, dated Feb. 26, 2020.

Notification to Grant Patent Right for Invention in counterpart Chinese Application No. 201811598783.2, dated Aug. 3, 2020.

* cited by examiner

| corresponding relationship between current and preset number | calculation number 1 |
|---|---|
| 0-Iocp/10 | calculation number 2 |
| 0-Iocp/10-2Iocp/10 | |
| ..... | ..... |
| 9Iocp/10-Iocp | calculation number 10 |

OVER-CURRENT PROTECTION METHOD FOR DISPLAY PANEL AND DISPLAY DEVICE

CROSS REFERENCES TO RELATED APPLICATIONS

The present application is the National Stage of International Application No. PCT/CN2019/124553, filed on Dec. 11, 2019, which claims priority to Chinese patent application No. 201811598783.2, filed on Dec. 25, 2018, and entitled "Over-current Protection Method for Display Device and Display Device", the entire content of which is incorporated herein by reference.

TECHNICAL FIELD

The present application relates to display technical field, and particular to an over-current protection method for display panel and display device.

BACKGROUND

The statements here only provide background information related to the present application, and do not mean it must constitute prior art.

At present, the over-current protection mechanism of the gate drive circuit (Gate Driver on Array, GOA) in the display panel is to cut off the power supply of the gate drive circuit when it detects that the current input by the level shifter is too large at the moment of startup. However, if external interference causes the current input by the level shifter to increase instantaneously, the over-current protection mechanism will be triggered by mistake, resulting in a screen of the display device becoming black. If the current input of the level shifter is detected to be too large at the moment of power-on and the over-current protection mechanism isn't activated, the current input by the level shifter being large enough will result in damaging the chip.

SUMMARY

The embodiments of the present application provide an over-current protection method for display panel and a display device, aiming to avoid damaging the chip due to excessive current input by the level shifter.

In order to achieve the above purpose, the present application provides an over-current protection method for display panel, the over-current protection method for display panel includes the following steps:

calculating an current input by a level shifter during a first preset time of a first clock signal after the first clock signal is received;

determining whether the current input by the level shifter during the first preset time is larger than the first preset current;

controlling the level shifter to stop running in determining that the current input by the level shifter during the first preset time is larger than the first preset current.

In order to achieve the above purpose, the present application provides an over-current protection method for display panel, which applied on a timing controller, the over-current protection method for display panel includes the following steps:

calculating an average current input by a level shifter during a first preset time of a first clock signal after the first clock signal is received;

determining whether the average current input by the level shifter during the first preset time is larger than the first preset current;

controlling the level shifter to stop running in determining that the average current input by the level shifter during the first preset time is larger than the first preset current.

In order to achieve the above purpose, the present application provides an display device, which includes a memory, a processor, and an over-current protection program for display panel stored on the memory and running on the processor, when the processor executes the over-current protection program of the display panel, the processor implements the following steps:

calculating a current input by a level shifter during a first preset time of a first clock signal after the first clock signal is received;

determining whether the current input by the level shifter during the first preset time is larger than the first preset current;

controlling the level shifter to stop running in determining that the current input by the level shifter during the first preset time is larger than the first preset current.

A solution of the present application determines whether current input by a level shifter during a first preset time is larger than a first preset current after a first clock signal is received; and controls the level shifter to stop running in determining that the current input by a level shifter during a first preset time is larger than a first preset current, thereby avoiding damaging a chip due to the overlarge current input by the level shifter.

DETAILED DESCRIPTION OF THE EMBODIMENTS

It should be understood that the specific embodiments described here are merely used to explain the present application, and not limited thereto.

A main solution of embodiments of the present application is: calculating current input by a level shifter during a first preset time of a first clock signal after the first clock signal is received; determining whether the current input by the level shifter during the first preset time is larger than a first preset current; controlling the level shifter to stop running in determining that the current input by the level shifter during the first preset time is larger than the first preset current.

The solution of the present application controls a level shifter to stop running in determining that current input by the level shifter during a first preset time of a first clock signal is detected to be larger than a first preset current, thereby avoiding damaging a chip due to overlarge current input by the level shifter.

Figure 1:
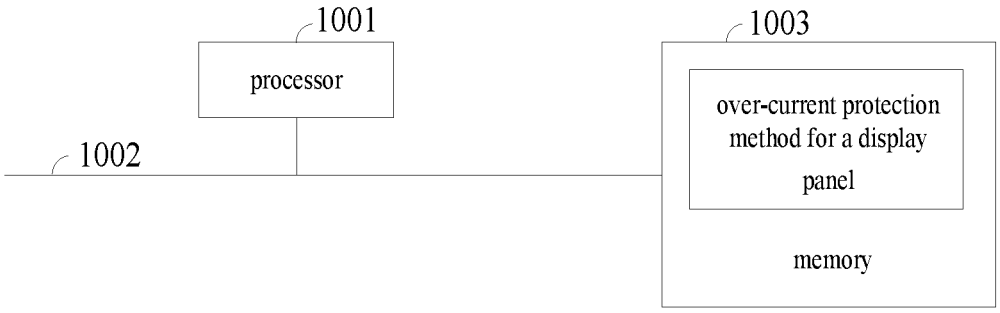
FIG. 1 is a schematic diagram of the structure of an electronic device in a hardware operating environment involved in an embodiment of the present application.

As an embodiment, a display device can be shown in FIG. 1.

An embodiment of the present application relates to a display device, the display device includes a processor 1001, such as CPU, a communication bus 1002, a memory 1003. The communication bus 1002 is configured to implement connection and communication between these components.

The memory 1003 can be a high-speed RAM memory, or a stable memory (non-volatile memory), such as a disk memory. As shown in FIG. 1, the memory 1003, as a computer storage medium, can include an over-current protection program for display panel; and the processor 1001 can be configured to call the over-current protection program for display panel stored in the memory 1003, and perform the following operations:

calculating a current input by a level shifter during a first preset time of a first clock signal after the first clock signal is received;

determining whether the current input by the level shifter during the first preset time is larger than a first preset current;

controlling the level shifter to stop running in determining that the current input by the level shifter during the first preset time is larger than the first preset current.

Optionally, the processor 1001 can be configured to call the over-current protection program for display panel stored in the memory 1003, and perform the following operations:

calculating the current input by the level shifter during a second preset time in determining that the current input by the level shifter during the first preset time is less than the first preset current;

determining whether the current input by the level shifter during the second preset time is larger than a second preset current;

controlling the level shifter to stop running in determining that the current input by the level shifter during the second preset time is larger than the second preset current.

Optionally, the processor 1001 can be configured to call an over-current protection program for display panel stored in the memory 1003, and perform the following operations:

calculating an effective current input by the level shifter during effective time of each clock signal;

calculating an average current input by the level shifter during the second preset time according to the effective current input by the level shifter during the effective time of each clock signal;

Optionally, the processor 1001 can be configured to call the over-current protection program for display panel stored in the memory 1003, and perform the following operations:

obtaining a preset number of inputting an effective current by the level shifter according to the effective current input by the level shifter during the effective time of each clock signal;

accumulating preset numbers of the clock signals to obtain a total preset number m;

calculating the average current input by the level shifter during the second preset time according to a formula I=m*Iocp/10n, where the Iocp is a current threshold, and n is a number of the clock signals.

Optionally, the processor 1001 can be configured to call the over-current protection program for display panel stored in the memory 1003, and perform the following operations:

accumulating the effective currents input by the level shifter during the effective times of the clock signals to obtain a sum of the effective currents;

calculating a ratio of the sum of the effective currents to the number of the clock signals to obtain the average current input by the level shifter during the second preset time.

Optionally, the processor 1001 can be configured to call the over-current protection program for display panel stored in the memory 1003, and perform the following operations:

the first preset current being larger than the preset current.

Optionally, the processor 1001 can be configured to call the over-current protection program for display panel stored in the memory 1003, and perform the following operations:

the second preset time is an accumulation of the effective times of the clock signals.

Optionally, the processor 1001 can be configured to call the over-current protection program for display panel stored in the memory 1003, and perform the following operations:

the effective time is a time of inputting a normal working time by the level shifter during each clock signal, the effective current is the average current input by the level shifter during each effective time.

Optionally, the processor 1001 can be configured to call the over-current protection program for display panel stored in the memory 1003, and perform the following operations:

calculating an average current input by the level shifter during a first preset time of a first clock signal after the first clock signal is received;

determining whether the average current input by the level shifter during the first preset time is larger than a first preset current;

controlling the level shifter to stop running in determining that the average current input by the level shifter during the first preset time is larger than the first preset current.

Figure 2:
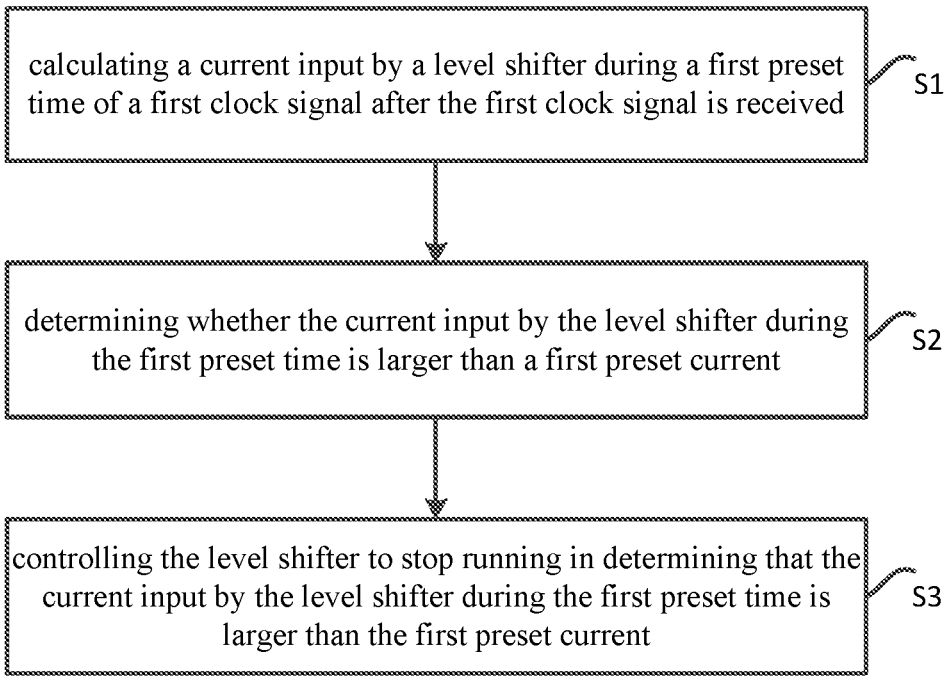
FIG. 2 is a schematic flowchart of an embodiment of an over-current protection method for display panel according to the present application.

FIG. 2 is a schematic flowchart of an embodiment of an over-current protection method for display panel according to the present application;

the over-current protection method for display panel includes:

Step S1, calculating a current input by a level shifter during a first preset time of a first clock signal after the first clock signal is received.

Figure 3:
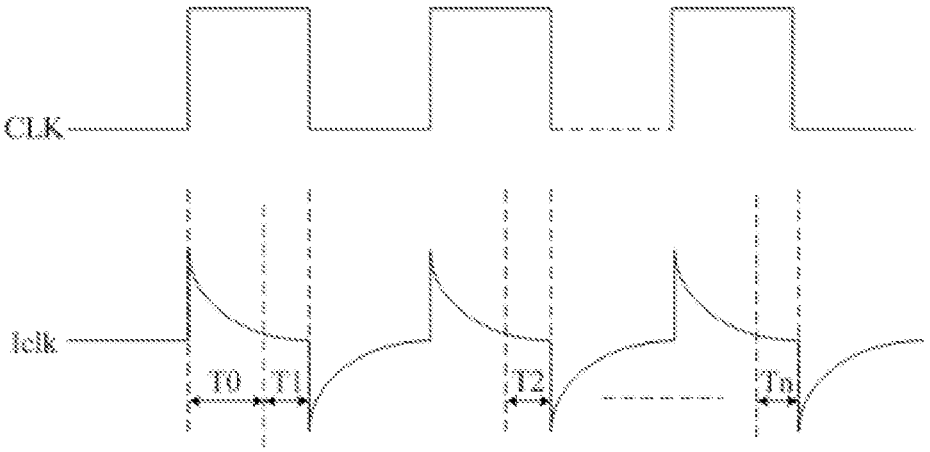
FIG. 3 is a schematic diagram of distribution of a first preset time and an effective time according to an embodiment of the present application.

The first preset time is the duration before the level shifter inputs a normal working current during the first clock signal, that is, the first preset time is the duration before the current input the level shifter is stable, and the first preset time is represented by T0. For example, if the duration of inputting a high level by the level shifter is 14.8 us during one clock signal, and the duration before the current input by the level shifter becomes a normal working current is 9 us, the first preset time T0 is 9 us. As shown in FIG. 3, a timing controller detects the current input by the level shifter during T0, and the detected current can be the average current during T0.

Step S2, determining whether the current input by the level shifter during the first preset time is larger than a first preset current.

The first preset current is set based on results of multiple experiments with conventional circuits, the first preset current is set as a basis of determining whether to control the level shifter to stop running during T0. After the average current input by the level shifter during T0 is obtained, the average current input by the level shifter during T0 is compared with the first preset current to obtain a comparison result.

Step S3, controlling the level shifter to stop running in determining that the current input by the level shifter during the first preset time is larger than the first preset current.

When the timing controller detects that the average current input by the level shifter during T0 is larger than the first preset current, it means that the current input by the level shifter is overlarge at this time, which will cause a chip to be damaged. The chip can be a level shifter chip. The level shifter is electrically connected to a gate drive circuit. At this time, the timing controller outputs a corresponding control signal, such as a high-level control signal is output to the level shifter to control the level shifter to stop running, thereby avoiding damaging the chip. With such an arrangement, whether to control the level shifter to stop running is determined by calculating the average current input by the level shifter during T0 of a first clock signal, such that the determination result is more accurate, and black screen of the display device due to accidental power failure can be avoided.

The solution of the present application determines whether current input by a level shifter during a first preset time is larger than a first preset current after a first clock signal is received, and controls the level shifter to stop running in determining that the current input by the level shifter during the first preset time is larger than the first preset current, thereby avoiding damaging a chip due to overlarge current input by the level shifter, as well as accidental power failure due to instantaneous overlarge current.

Figure 4:
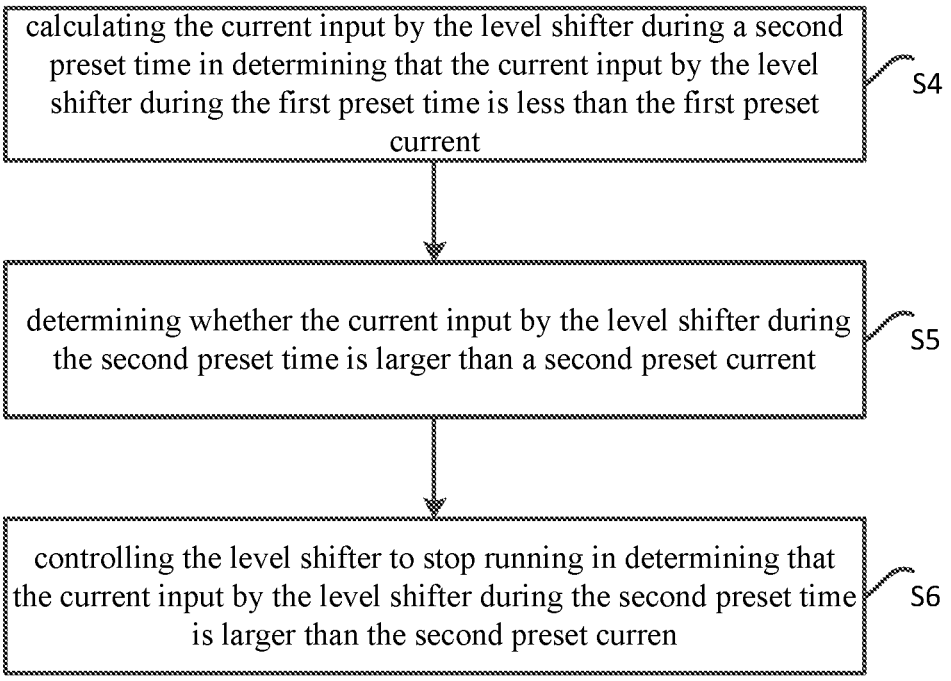
FIG. 4 is a schematic flowchart of another embodiment of the over-current protection method for display panel according to the present application.

FIG. 4 is a schematic flowchart of another embodiment of the over-current protection method for display panel according to the present application;

Based on the above embodiments, after Step S2, the method further includes:

Step S4, calculating the current input by the level shifter during a second preset time in determining that the current input by the level shifter during the first preset time is less than the first preset current.

The second preset time is an accumulation of effective times of multiple clock signals, an effective time represents a time of inputting a normal working time by the level shifter during each clock signal, that is, the effective time is the duration of current input by the level shifter being stable. For example, during one clock signal, if the duration of the high-level input by the level shifter is 14.8 us, and the duration of inputting normal working current by the level shifter is 5.8 us, the effective time is 5.8 us. Referring to FIG. 3, the effective time of the first clock signal is represented by T1, the effective time of the second clock signal is represented by T2, and so on, the effective time of the nth clock signal is represented by Tn, a total time from T1 to Tn is taken as the second preset time. In determining that the current input by the level shifter during the first preset time is less than the first preset current, the timing controller calculates the current input by the level shifter during the second preset time, that is, the effective current input by the level shifter during the effective times T1, T2 . . . Tn is calculated. The average current input by the level shifter during the second preset time is calculated according to the effective current input by the level shifter during each clock signal.

Figure 5:
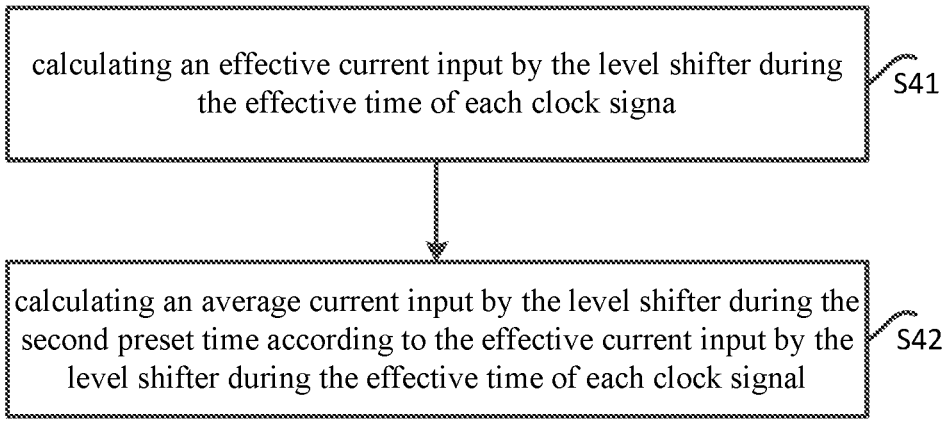
FIG. 5 is a detailed flowchart of step S4 according to an embodiment of the present application.

Specifically, referring to FIG. 5, Step S4 includes:

Step S41, calculating an effective current input by the level shifter during the effective time of each clock signal.

calculating, by the timing controller, an effective current input by the level shifter during the effective time of each clock signal, that is, calculating effective current input by the level shifter during T1, T2, . . . Tn, and the effective current can be an average current during each effective time.

Figure 6:
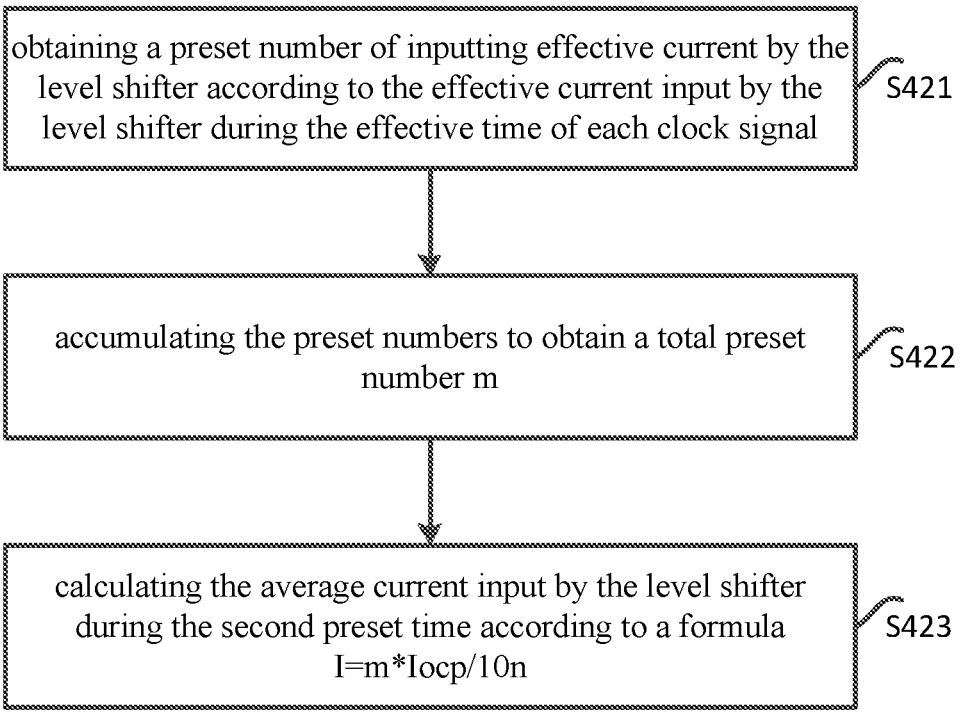
FIG. 6 is a detailed flowchart of step S42 according to an embodiment of the present application.
Figures 7, 8:
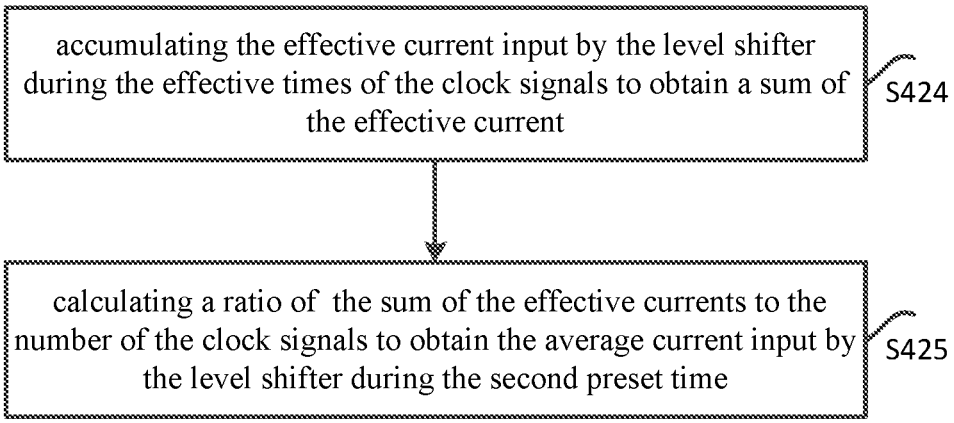
FIG. 7 is a schematic diagram of a corresponding relationship between current and preset times according to an embodiment of the present application.
FIG. 8 is another detailed flowchart of step S42 according to an embodiment of the present application.

Step S42, calculating an average current input by the level shifter during the second preset time according to the effective current input by the level shifter during the effective time of each clock signal;

After the effective current input by the level shifter during the effective time of each clock signal is obtained, the average current input by the level shifter during the second preset time is calculated according to the effective currents; Specifically, referring to FIG. 6, Step S42 includes:

Step S421, obtaining a preset number of inputting effective current by the level shifter according to the effective current input by the level shifter during the effective time of each clock signal;

The preset number represents a number of the instantaneous current input by the level shifter being larger than a current threshold Iocp during the effective time corresponding to the effective current, The current threshold can be set according to the maximum current that a load can stand. After the effective current of each clock signal is obtained, the preset number corresponding to each effective current is obtained according to a relationship between preset currents and preset numbers. As shown in FIG. 7, a range which the effective current of each clock signal falls in is determined, thereby the preset number corresponding to the effective current of each clock signal is obtained according to a one-to-one correspondence relationship between currents and preset numbers.

Step S422, accumulating the preset numbers to obtain a total preset number m;

The preset number corresponding to all the effective currents are accumulated to obtain a total preset number in a frame of time, and the total preset number is represented by m. For example, if the preset number corresponding to the effective current during the first clock signal is 1, the preset number corresponding to the effective current during the second clock signal is 2, and so on, the preset number corresponding to the effective current during the nth clock signal is a, then m=1+2+ . . . +a.

Step S423, calculating the average current input by the level shifter during the second preset time according to a formula I=m*Iocp/10n.

After the total preset number m during the second preset time is obtained, the average current during the second preset time is calculated by a formula I=m*Iocp/10n, where n is a number of the clock signals.

Optionally, referring to FIG. 8, Step S42 includes:

Step S424, accumulating the effective current input by the level shifter during the effective times of the clock signals to obtain a sum of the effective current;

In one embodiment, the effective current input by the level shifter during the second preset time can be calculated according to a sum of the effective currents input by the level shifter during the effective times of the clock signals, that is, the effective current input by the level shifter during the second preset time can be calculated by accumulating the effective currents during the clock signals to obtain a sum of the effective currents during the second preset time.

Step S425, calculating a ratio of the sum of the effective currents to the number of the clock signals to obtain the average current input by the level shifter during the second preset time.

After the sum of the effective currents of the clock signals is obtained, a ratio of the obtained sum of the effective currents to the number of clock signals is calculated. For example, the effective current during the first clock signal is I1, the effective current during the second clock signal is I2, and so on, the effective current during the nth clock signal is In, A sum Itotal of the effective currents is I1+I2+ . . . In, and a ratio of Itotal to n is calculated to obtain the average current during the second preset time.

Step S5, determining whether the current input by the level shifter during the second preset time is larger than a second preset current;

The second preset current is set based on results of multiple experiments with conventional circuits, the first preset current is set as a basis of determining whether to control the level shifter to stop running during the second preset time. The second preset current is less than the first preset current. After the average current input by the level shifter is obtained during the second preset time, the average current obtained is compared with the second preset current to obtain a comparison result.

Step S6, controlling the level shifter to stop running in determining that the current input by the level shifter during the second preset time is larger than the second preset current.

The average current input by the level shifter during the second preset time is larger than the second preset current, that means there may be dangerous for the chip. At this time, the timing controller outputs a corresponding control signal, for example a high-level control signal is output to the level shifter to control the level shifter to stop running, thereby avoiding damaging the chip. The average current input by the level shifter during the second preset time is calculated to determine whether the current input by the level shifter in the steady state meets the requirement, thereby determining whether it is necessary to control the level shifter to stop running. With such an arrangement, the accuracy of determining whether to cut off the power supply of the gate drive circuit is improved.

The solution of the present application outputs a control signal by the timing controller to control the level shifter to stop running when the average current input by the level shifter during the second preset time is detected to be larger than the second preset current, thereby avoiding damaging the chip due to overlarge current.

The present application also provides a display device, which includes a memory, a processor, and an over-current protection program for display panel stored in the memory and executable by the processor. When the processor executes the over-current protection program for display panel, the processor implements the following steps as mentioned above. The display device further comprises a display panel and a circuit board, the display panel is connected to the circuit board, and the over-current protection program for display panel is embedded in the circuit board.

The display device of the present embodiment can be a display device with a display panel such as a television, a tablet computer, a mobile phone, and so on. The display panel of the present embodiment can be any of the followings: a liquid crystal display panel, an OLED display panel, a QLED display panel, a twisted nematic (TN) or super twisted nematic (STN) type panel, a plane conversion (In-Plane Switching, IPS) type panel, a vertical alignment (VA) type panel, a curved panel, or other display panels.

The above descriptions are only optional embodiments of the application, and do not limit the scope of the patents of the application. Under the inventive concept of the present application, the equivalent structure transformations made by using the description and drawings of the present application, or direct/indirect applications in other related technical fields are included in the scope of patent protection of the present invention.

What is claimed is:

1. An over-current protection method for display panel, comprising the following steps:

calculating a current input by a level shifter during a first preset time of a first clock signal after the first clock signal is received;

determining whether the current input by the level shifter during the first preset time is larger than a first preset current; and controlling the level shifter to stop running in determining that the current input by the level shifter during the first preset time is larger than the first preset current, wherein after the determining whether the current input by the level shifter during the first preset time is larger than the first preset current, the method further comprises:

calculating the current input by the level shifter during a second preset time in determining that the current input by the level shifter during the first preset time is less than the first preset current;

determining whether the current input by the level shifter during the second preset time is larger than a second preset current; and controlling the level shifter to stop running in determining that the current input by the level shifter during the second preset time is larger than the second preset current, wherein the calculating the current input by the level shifter during the second preset time in determining that the current input by the level shifter during the first preset time is less than the first preset current comprises:

calculating an effective current input by the level shifter during an effective time of each clock signal; and calculating an average current input by the level shifter during the second preset time according to the effective current input by the level shifter during the effective time of each clock signal, wherein the calculating the average current input by the level shifter during the second preset time according to the effective current input by the level shifter during the effective time of each clock signal comprises:

obtaining a preset number of inputting the effective current by the level shifter according to the effective current input by the level shifter during the effective time of each clock signal;

accumulating preset numbers of clock signals to obtain a total preset number m; and calculating the average current input by the level shifter during the second preset time according to a formula I=m*Iocp/10n, wherein Iocp is a current threshold, and n is a number of the clock signals.

2. The over-current protection method for display panel according to claim 1, wherein the preset number is a number of instantaneous currents input by the level shifter during the effective time of each clock signal being larger than the current threshold.

3. The over-current protection method for display panel according to claim 1, wherein the first preset current is larger than the second preset current.

4. The over-current protection method for display panel according to claim 1, wherein the second preset time is an accumulation of the effective times of the clock signals.

5. The over-current protection method for display panel according to claim 1, wherein the effective time is a time of inputting normal working current by the level shifter during each clock signal, the effective current is an average current input by the level shifter during each effective time.

6. The over-current protection method for display panel according to claim 1, wherein the first preset time is a duration before the level shifter inputs normal working current during the first clock signal.

7. A display device, comprising a memory, a processor, and an over-current protection program for display panel stored in the memory and executable by the processor, when the processor executes the over-current protection program for display panel, the following steps are realized:

calculating a current input by a level shifter during a first preset time of a first clock signal when the first clock signal is received;

determining whether the current input by the level shifter during the first preset time is larger than a first preset current; and controlling the level shifter to stop running when the current input by the level shifter during the first preset time is larger than the first preset current, wherein after the determining whether the current input by the level shifter during the first preset time is larger than the first preset current, the method further comprises:

calculating the current input by the level shifter during a second preset time in determining that the current input by the level shifter during the first preset time is less than the first preset current;

determining whether the current input by the level shifter during the second preset time is larger than a second preset current; and controlling the level shifter to stop running in determining that the current input by the level shifter during the second preset time is larger than the second preset current, wherein the calculating the current input by the level shifter during the second preset time in determining that the current input by the level shifter during the first preset time is less than the first preset current comprises:

calculating an effective current input by the level shifter during an effective time of each clock signal; and calculating an average current input by the level shifter during the second preset time according to the effective current input by the level shifter during the effective time of each clock signal, wherein the calculating the average current input by the level shifter during the second preset time according to the effective current input by the level shifter during the effective time of each clock signal comprises:

obtaining a preset number of inputting the effective current by the level shifter according to the effective current input by the level shifter during the effective time of each clock signal;

accumulating preset numbers of clock signals to obtain a total preset number m; and calculating the average current input by the level shifter during the second preset time according to a formula $I=m*Iocp/10n$, wherein Iocp is a current threshold, and n is a number of the clock signals.

8. The display device according to claim 7, wherein the display device further comprises a display panel and a circuit board, the display panel being connected to the circuit board, the over-current protection program for display panel being embedded in the circuit board.

9. The display device according to claim 8, wherein the display device is a television, the display panel is a liquid crystal display panel.

* * * * *